US007328468B2

(12) United States Patent
Korshamn

(10) Patent No.: US 7,328,468 B2
(45) Date of Patent: Feb. 12, 2008

(54) SLEEPING BAG FOR CHILDREN

(75) Inventor: Bodil Korshamn, Rindal (NO)

(73) Assignee: HTS Hans Torgersen & Sonn AS, Kroderen (NO)

( * ) Notice: Subject to any disclaimer, the term of this patent is extended or adjusted under 35 U.S.C. 154(b) by 30 days.

(21) Appl. No.: 10/552,704

(22) PCT Filed: Mar. 24, 2004

(86) PCT No.: PCT/NO2004/000081

§ 371 (c)(1),
(2), (4) Date: Nov. 14, 2005

(87) PCT Pub. No.: WO2004/089171

PCT Pub. Date: Oct. 21, 2004

(65) Prior Publication Data

US 2006/0207024 A1 Sep. 21, 2006

(30) Foreign Application Priority Data

Apr. 14, 2003 (NO) ..... 20031717

(51) Int. Cl.
*A47G 9/08* (2006.01)

(52) U.S. Cl. ..... 5/413 R; 2/69.5

(58) Field of Classification Search ..... 5/413 R, 5/413 AM, 494; 2/69.5
See application file for complete search history.

(56) References Cited

U.S. PATENT DOCUMENTS

| | | | | |
|---|---|---|---|---|
| 3,564,629 | A | 2/1971 | Rogius | |
| 4,989,282 | A * | 2/1991 | Goldstein | 5/413 R |
| 5,533,216 | A | 7/1996 | Thier | |
| 5,622,300 | A * | 4/1997 | Robinson | 224/575 |
| 5,960,492 | A * | 10/1999 | Byrne | 5/413 R |
| 6,195,822 | B1 * | 3/2001 | Sorensen et al. | 5/628 |
| 6,292,961 | B1 * | 9/2001 | Ganio et al. | 5/413 R |

FOREIGN PATENT DOCUMENTS

| | | |
|---|---|---|
| DE | 8909142 | 11/1989 |
| FI | 56832 | 5/1974 |
| FI | 61260 | 2/1981 |
| FI | 65570 | 4/1987 |

* cited by examiner

*Primary Examiner*—Patricia Engle
*Assistant Examiner*—William J. Kelleher
(74) *Attorney, Agent, or Firm*—Dennison, Schultz & MacDonald

(57) ABSTRACT

Sleeping bag for children, having a main part including a collar and a bottom part, which during use of the sleeping bag for children, forms at least one part of its lying area, and where, along its lower edge, is fastened one part of a zipper for connection with a detachable supplementary part or a cover. The sleeping bag has at least two supplementary parts, of which one is generally shaped as a cover over the bottom part of the main part, and one is formed with a bag-forming part which forms an extending cover-shaped tongue.

4 Claims, 2 Drawing Sheets

SLEEPING BAG FOR CHILDREN

This application is a filing under 35 USC 371 of PCT/NO2004/000081 filed Mar. 24, 2004.

BACKGROUND OF THE INVENTION

The present invention relates to a sleeping bag for children A "sleeping bag for children" is defined as a thermal, insulated, bag-like textile object, which is used for covering new-born and babies.

A large number of proposals for such bags for children are known, having tongues and layers, which can be folded together to suit children of various sizes. It is a challenge, in general, to design sleeping bags for children in such a way that they can be used over a longer period of time, i.e. over a period of growth, during which the child develops from a length of say 50 cm, to a length of 100 cm or more. It is a general desire, that such equipment can be used by the child for as long as possible through their life, e.g. such that the bag can be used as a sleeping bag, even after the baby stage.

A first solution to this problem is disclosed in the Norwegian Registration of Design No. 65570, where adjustment of the bag to various sizes, is achieved through tongues and lacings.

Norwegian Registration of Design No. 56862 discloses a dual-purpose sleeping bag for children and a heating jacket. This design is not suitable for the manufacture of a flexible size sleeping bag for children.

Norwegian Registration of Design No. 61260 discloses a similar dual-purpose solution for an anorak and a sleeping bag, that has provided a basis for the manufacture of a sleeping bag for children, of a flexible size.

None of these proposals provides for a sleeping bag for children, having a flexibility in size.

SUMMARY OF THE INVENTION

The main object of the present invention is to provide a sleeping bag for children, having a greater flexibility for size than known sleeping bags for children. It is a particular object to design a sleeping bag for children, which can be extended in length, in such a way that it can be used as a sleeping bag for larger children, also allowing it to be utilized by a child of a greater age than the known sleeping bags for children permit.

THE INVENTION

The object of the invention can be fulfilled by a sleeping bag for children The invention is described more precisely by the following example.

BRIEF DESCRIPTION OF THE DRAWINGS

The invention is illustrated by the drawings, wherein.

DESCRIPTION OF THE PREFERRED EMBODIMENTS

Figure 1:
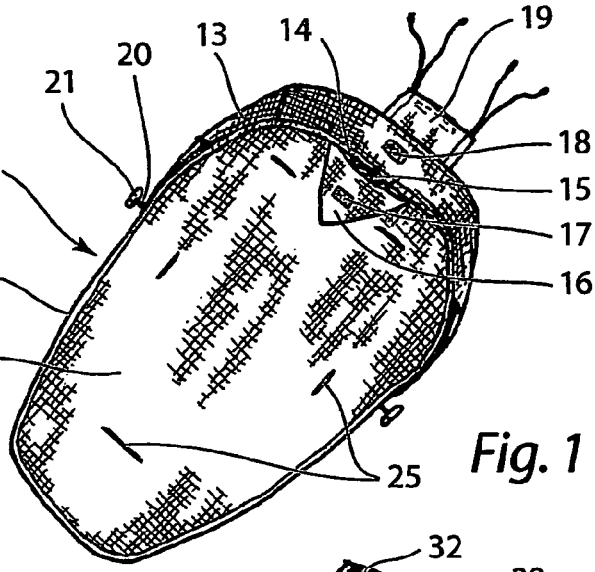
FIG. 1 is a perspective view of a main part.

FIG. 1 shows a main part 11 of a sleeping bag for children according to the invention. It includes a bottom part 12, having a top, which is roundly cut, and a collar 13, formed as a cap, around the upper part. In the collar 13, provided a passage, having two tensioning strings 14 and 15, which meet at the top, and which can be placed into a triangular, internal pocket 16, making them inaccessible to the child. The pocket 16 has a VELCRO® hook and loop fastener 17 which can be fastened to a counterpart VELCRO® fastener 18, outside the collar 13. The collar 13 can, by use of the tensioning strings 14 and 15, be contracted into a cap that covers a larger area of the bottom part 12, than is shown in the figure.

Outside the collar 13, a rectangular pocket 19 is provided, which protrudes and the task of which is to stabilize the sleeping bag for children in a carriage, on a desk or on a chair sledge, by fastening it to a carrying part.

At each end of the collar 13, a loop 20 is fastened, having a cross pin 21, which can be hooked into a corresponding loop on the supplementary parts, as described below.

Along the free edge of the bottom part 12, one part 24 of a zipper is fastened. The bottom part 12 has through slits 25 for passing of fastening straps or strings.

Figure 2:
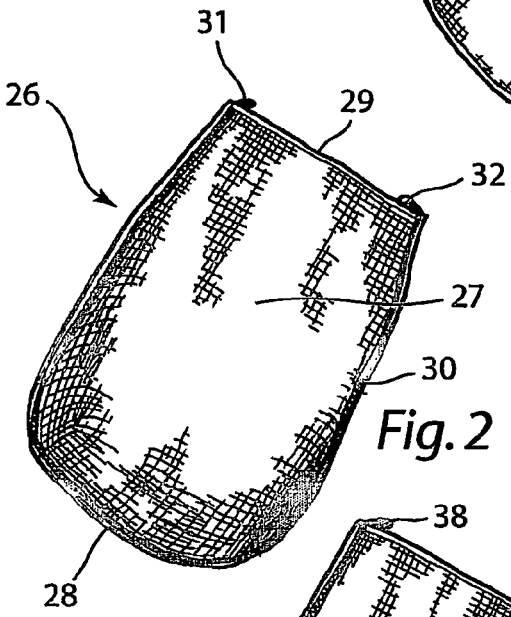
FIGS. 2 and 3 are perspective views of a first supplementary part, from the front and from behind, respectively.
Figure 3:
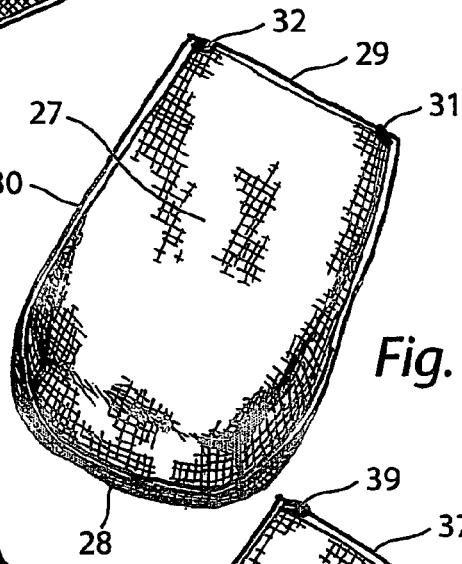

FIGS. 2 and 3 show a first supplementary part 26, which corresponds to the main part and has a bottom part 27, and a collar 28, which converges with the increasing width, out from both the ends of a cross edge 29. The collar has a zipper 30, which corresponds to the zipper 24, and can be fastened to this. At the ends of the zipper 30, are loops 31 and 32, to which the cross pins 21 are fastened.

Figure 4:
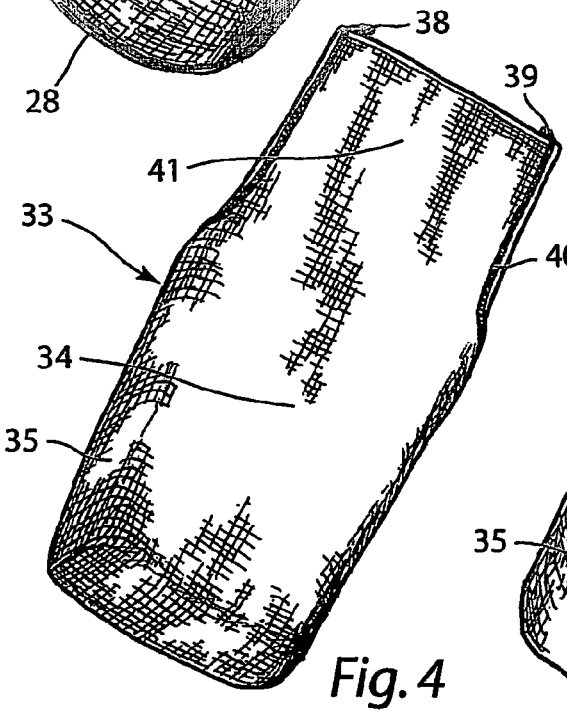
FIGS. 4 and 5 are corresponding views of a second supplementary part.
Figure 5:
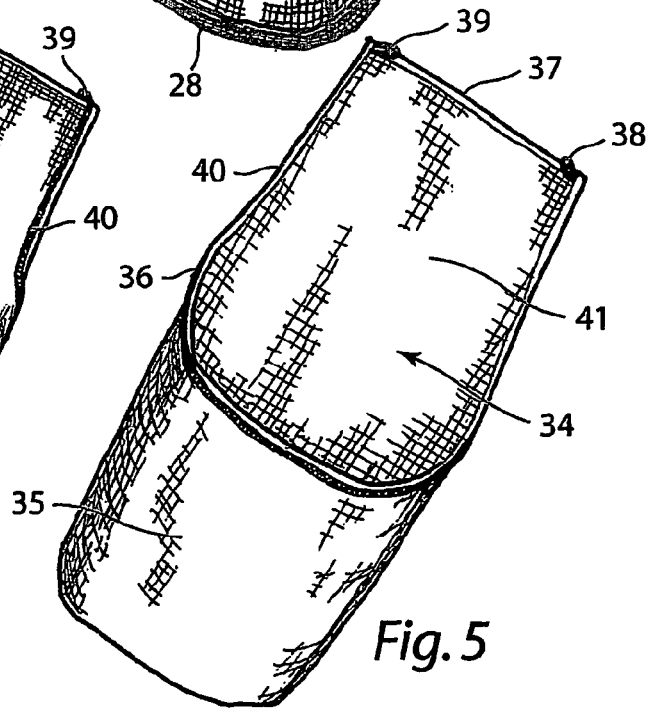

FIGS. 4 and 5 show a second supplementary part 33, having a bottom part 34, and an end part 35, which is forming a bag. The free edge 36 of the end part 35, converges in a wedge-shape towards each of ends of end edge 37 of the bottom part 34. Here, loops 38 and 39, are fastened in a positions corresponding to loops 31 and 32 on the first supplementary part. Along the free edge of the end part 35, a zipper 40 is fastened, which corresponds to position of zipper 30 on the first supplementary part 26. The free end of the bottom part 34 forms a tongue 41, having a straight edge.

Figure 6:
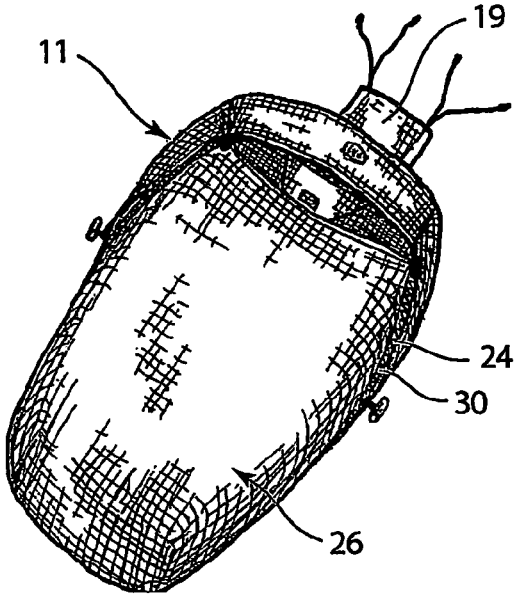
FIGS. 6 and 7 are perspective views of a sleeping bag for children, according to the invention, in a short variant.
Figure 7:
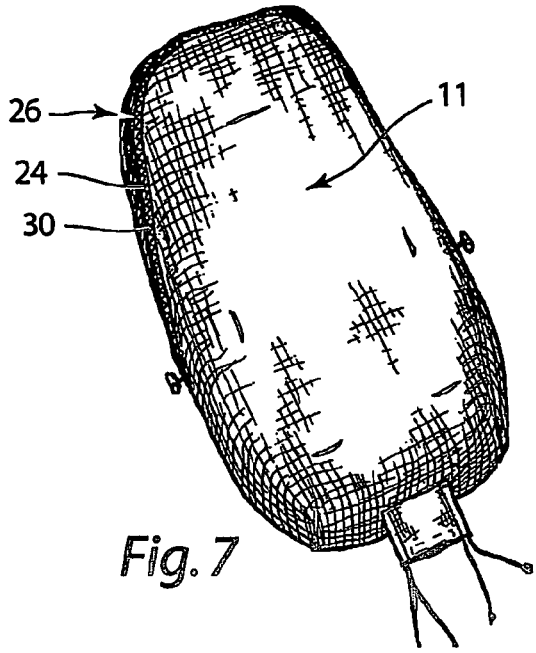

FIGS. 6 and 7 shows how the main part 11 may be put together with the first supplementary part 26, forming a closed sleeping bag for children, having a short length.

Figure 8:
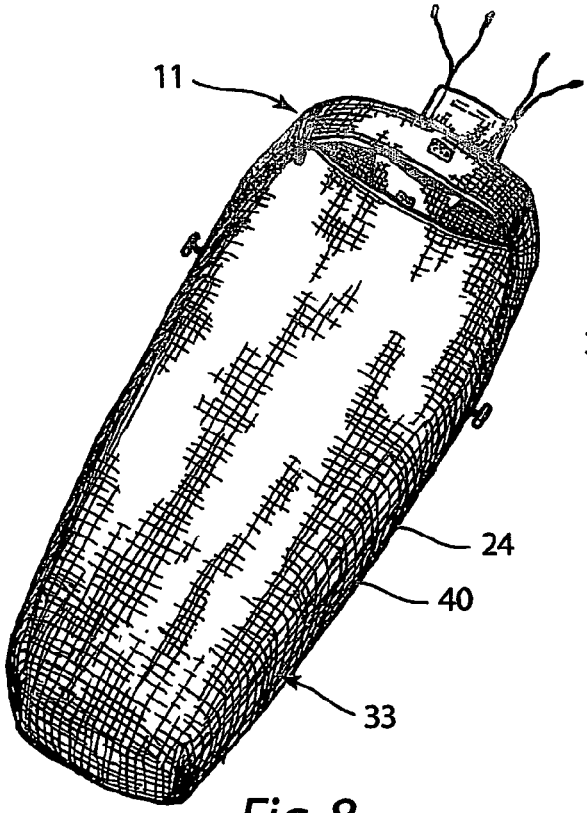
FIGS. 8 and 9 are corresponding views of FIGS. 6 and 7, of a long variant of the sleeping bag for children.
Figure 9:
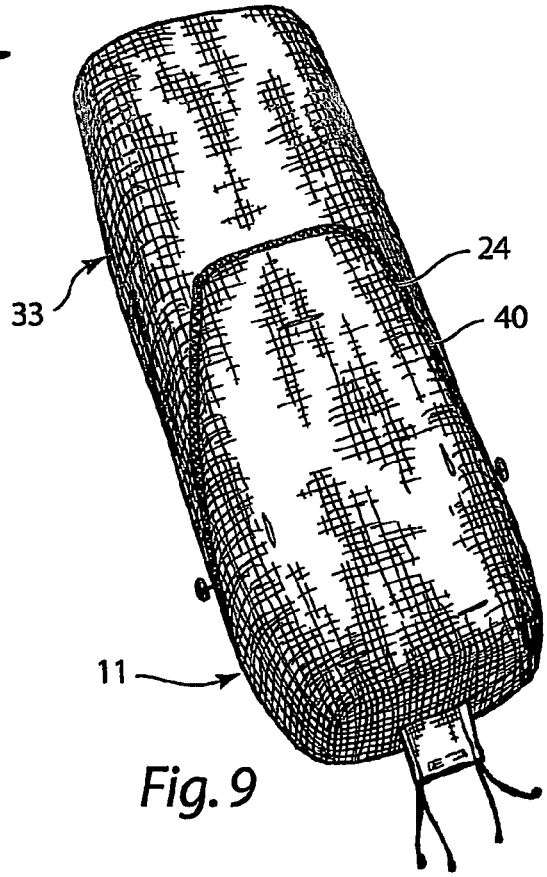

FIGS. 8 and 9 shows how the main part 11 may be put together with the second supplementary part 33, forming a sleeping bag for children, having a longer length. In both cases, the zippers 24 and 30 and 40, respectively, are used as detachable fastening means.

The invention claimed is:

1. Sleeping bag for children comprising a bottom part and at least first and second supplementary parts, the bottom part having a free end from which an edge is extended to form an upper end wall or a collar, a first supplementary part comprising a bottom portion, a collar portion and a head opening portion, and which detachably connects to the bottom part in such a way that a closed bag is formed together with the bottom part at an end of the bottom part opposite to a head receiving portion, the head receiving portion being defined by the head opening portion and the upper end wall or collar, means for detachably connecting the first supplementary part to the bottom part comprising a zipper means extending from a first end at the head opening portion to a second end at the head opening portion, around the collar portion, and corresponding zipper means extending peripherally around the opposite end of the bottom part in its entirety, and a second supplementary part which detachably connects to the bottom part and which is interchangeable with the first supplementary part, the second supplementary part comprising a head opening portion, a tongue part extending from the head opening portion, a bag-shaped main part extending from the tongue part, and zipper means corresponding to the zipper means of the bottom part and which extends around sides of the tongue part and the bag-shaped main part, wherein interchanging the second supplementary part for the first supplementary part increases bag length opposite to the head receiving portion.

2. Sleeping bag for children according to claim 1, wherein the collar portion of the first supplementary part has a width which increases from the ends of the zipper towards the bottom portion.

3. Sleeping bag for children according to claim 1, additionally comprising a closable pocket in the upper end wall or collar of bottom part.

4. Sleeping bag for children according to claim 2, additionally comprising a closable pocket in the upper end wall or collar of bottom part.

* * * * *